US007419016B2

(12) United States Patent
Hall et al.

(10) Patent No.: US 7,419,016 B2
(45) Date of Patent: Sep. 2, 2008

(54) BI-CENTER DRILL BIT

(76) Inventors: David R. Hall, 2185 S. Larsen Pkwy., Provo, UT (US) 84606; Francis Leany, 2185 S. Larsen Pkwy., Provo, UT (US) 84606; Scott Dahlgren, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 63 days.

(21) Appl. No.: 11/680,997

(22) Filed: Mar. 1, 2007

(65) Prior Publication Data

US 2007/0221416 A1 Sep. 27, 2007

Related U.S. Application Data

(63) Continuation-in-part of application No. 11/673,872, filed on Feb. 12, 2007, which is a continuation-in-part of application No. 11/611,310, filed on Dec. 15, 2006, application No. 11/680,997, which is a continuation-in-part of application No. 11/278,935, filed on Apr. 6, 2006, which is a continuation-in-part of application No. 11/227,394, filed on Mar. 24, 2006, which is a continuation-in-part of application No. 11/277,380, filed on Mar. 24, 2006, now Pat. No. 7,337,856, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 10/26* (2006.01)

(52) U.S. Cl. ..... 175/399; 175/385; 175/415

(58) Field of Classification Search ..... 175/399, 175/400, 385, 389, 415
See application file for complete search history.

(56) References Cited

U.S. PATENT DOCUMENTS

| | | | | |
|---|---|---|---|---|
| 465,103 | A | 12/1891 | Wegner | |
| 616,118 | A | 12/1898 | Kunhe | |
| 946,060 | A | 1/1910 | Looker | |
| 1,116,154 | A | 11/1914 | Stowers | |
| 1,183,630 | A | 5/1916 | Bryson | |
| 1,189,560 | A | 7/1916 | Gondos | |
| 1,360,908 | A | 11/1920 | Everson | |
| 1,387,733 | A | 6/1921 | Midgec | |
| 1,460,671 | A | 7/1923 | Hebsacker | |
| 1,544,757 | A | 7/1925 | Hufford | |
| 1,746,455 | A * | 2/1930 | Woodruff et al. | 175/298 |
| 1,821,474 | A | 9/1931 | Mercer | |

(Continued)

*Primary Examiner*—Hoang Dang
(74) *Attorney, Agent, or Firm*—Tyson J. Wilde

(57) ABSTRACT

In one aspect of the present invention a drill bit assembly comprises a working portion opposite a shank of the bit. The working portion has a plurality of cutting elements. The drill bit assembly also has a central axis eccentric to its axis of rotation. A jack element protrudes from an opening formed in the working portion and has a distal end that is adapted to contact a formation at the axis of rotation.

20 Claims, 11 Drawing Sheets

U.S. PATENT DOCUMENTS 1,879,177 A 9/1932 Gault
2,054,255 A 9/1936 Howard
2,064,255 A 12/1936 Garfield
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,163,243 A * 12/1964 Cleary ..... 175/389
3,294,186 A 12/1966 Buell
3,301,339 A 1/1967 Pennebaker, Jr.
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa et al.
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,052,503 A * 10/1991 Lof ..... 175/258
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,978,644 A 11/1999 Sato et al.
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine et al.
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswami
6,880,648 B2 * 4/2005 Edscer ..... 175/61
6,929,076 B2 8/2005 Fanuel
6,953,096 B2 10/2005 Gledhill
2003/0213621 A1 11/2003 Britten
2004/0238221 A1 12/2004 Runia
2004/0256155 A1 12/2004 Knesels

* cited by examiner

BI-CENTER DRILL BIT

CROSS REFERENCE TO RELATED APPLICATIONS

This Patent Application is a continuation-in-part of U.S. patent application Ser. No. 11/673,872 filed on Feb. 12, 2007 and entitled Jack Element in Communication with an Electric Motor and/or generator. U.S. patent application Ser. No. 11/673,872 is a continuation-in-part of U.S. patent application Ser. No. 11/611,310 filed on Dec. 15, 2006 and which is entitled System for Steering a Drill String. This Patent Application is also a continuation-in-part of U.S. patent application Ser. No. 11/278,935 filed on Apr. 6, 2006 and which is entitled Drill Bit Assembly with a Probe. U.S. patent application Ser. No. 11/278,935 is a continuation-in-part of U.S. patent application Ser. No. 11/277,394 which filed on Mar. 24, 2006 and entitled Drill Bit Assembly with a Logging Device. U.S. patent application Ser. No. 11/277,394 is a continuation in-part of U.S. patent application Ser. No. 11/277,380 also filed on Mar. 24, 2006 and entitled A Drill Bit Assembly Adapted to Provide Power Downhole, now U.S. Pat. No. 7,337,856 . U.S. patent application Ser. No. 11/277,380 is a continuation-in-part of U.S. patent application Ser. No. 11/306,976 which was filed on Jan. 18, 2006 and entitled Drill Bit Assembly for Directional Drilling, now U.S. Pat. No. 7,360,610. U.S. patent application Ser. No. 11/306,976 is a continuation in-part of 11/306,307 filed on Dec. 22, 2005, entitled Drill Bit Assembly with an Indenting Member, now U.S. Pat. No. 7,225,886. U.S. patent application Ser. No. 11/306,307 is a continuation in-part of U.S. patent application Ser. No. 11/306,022 filed on Dec. 14, 2005, entitled Hydraulic Drill Bit Assembly, now U.S. Pat. No. 7,198,119 . U.S. patent application Ser. No. 11/306,022 is a continuation in-part of U.S. patent application Ser. No. 11/164,391 filed on Nov. 21, 2005, which is entitled Drill Bit Assembly, now U.S. Pat. No. 7,270,196. All of these applications are herein incorporated by reference in their entirety.

BACKGROUND OF THE INVENTION

This invention relates to drill bits, specifically drill bit assemblies for use in oil, gas and geothermal drilling. Various methods have been devised for passing a drill bit assembly through an existing cased borehole and permitting the drill bit assembly to drill a new portion of the borehole that is of a larger diameter than the inside diameter of the existing borehole. However, bi-center drill bits often experience bit whirl because of the harsh conditions as well as the lack of stability when drilling below the earth's surface.

The prior art has addressed issues dealing with the stabilization of drill bits, specifically bi-center drill bits. Such issues have been addressed in the U.S. Pat. No. 5,957,223 to Duster, which is herein incorporated by reference for all that it contains. The '223 patent discloses a method and apparatus for reaming or enlarging a borehole using a bi-center bit with a stability-enhanced design. The cutters on the pilot bit section of the bi-center bit are placed and oriented to generate a lateral force vector longitudinally offset from, but substantially radically aligned with, the much larger lateral force vector generated by the reamer bit section. These two aligned force vectors thus tend to press the bit in the same lateral direction (which moves relative to the borehole sidewall as the bit rotates) along its entire longitudinal extent so that a single circumferential area of the pilot bit section gage rides against the sidewall of the pilot borehole, resulting in a reduced tendency for the bit to cock or tilt with respect to the axis of the borehole. Further, the pilot bit section includes enhanced gage pad area to accommodate this highly-focused lateral loading, particularly that attributable to the dominant force vector generated by the reamer bit section, so that the pilot borehole remains in-gage and round in configuration, providing a consistent longitudinal axis for the reamer bit section to follow.

U.S. Pat. No. 5,979,577 to Fielder which is herein incorporated by reference for all that it contains, discloses a drilling tool operational with a rotational drive source for drilling in a subterranean formation where the tool comprises a body defining a face disposed about a longitudinal axis, a plurality of cutting elements fixedly disposed on and projecting from the tool face and spaced apart from one another, and one or more stabilizing elements disposed on the tool face and defining a beveled surface.

U.S. Pat. No. 6,227,312 to Eppink, et al. which is herein incorporated by reference for all that it contains, discloses a drilling assembly that includes an eccentric adjustable diameter blade stabilizer and has a housing with a fixed stabilizer blade and a pair of adjustable stabilizer blades. The adjustable stabilizer blades are housed within openings in the stabilizer housing and have inclined surfaces which engage ramps on the housing for cramming the blades radically upon their movement axially. The adjustable blades are operatively connected to an extender piston on one end for extending the blades and a return spring at the other end for contracting the blades. The eccentric stabilizer also includes one or more flow tubes through which drilling fluids pass that apply a differential pressure across the stabilizer housing to actuate the extender pistons to move the adjustable stabilizer blades axially upstream to their extended position. The eccentric stabilizer is mounted on a bi-center bit which has an eccentric reamer section and a pilot bit. In the contracted position, the areas of contact between the eccentric stabilizer and the borehole form a contact axis which is coincident with the pass through axis of the bi-center bit as the drilling assembly passes through the existing cased borehole. In the extended position, the extended adjustable stabilizer blades shift the contact axis such that the areas of contact between the eccentric stabilizer and the borehole form a contact axis which is coincident with the axis of the pilot bit so that the eccentric stabilizer stabilizes the pilot bit in the desired direction of drilling as the eccentric reamer section reams the new borehole.

U.S. Pat. No. 6,659,207 to Hoffmaster, et al. which is herein incorporated by reference for all that it contains, discloses a bi-center drill bit which includes a bit body having pilot blades and reaming blades distributed azimuthally around the body. The blades have cutting elements disposed thereon at selected positions. The body and blades define a longitudinal axis of the bit and a pass-through axis of the bit. In one aspect, selected ones of the pilot blades include thereon, longitudinally between the pilot blades and the reaming blades, a pilot hole conditioning section including gage faces. The gage faces define a diameter intermediate a pilot hole diameter and a pass-through diameter defined, respectively, by the pilot blades and the reaming blades.

BRIEF SUMMARY OF THE INVENTION

In one aspect of the present invention a drill bit assembly comprises a working portion opposite a shank of the bit. The working portion has a plurality of cutting elements. The drill bit assembly also has a central axis eccentric to its axis of rotation. A jack element protrudes from an opening formed in the working portion and has a distal end that is adapted to contact a formation at the axis of rotation. This may be beneficial such that the jack element stabilizes the drill bit during operation in down hole formations. In the preferred embodiment, the shank is adapted for connection to a down hole tool string component.

Two or more openings disposed in the working portion may be adapted to house separate jack elements. The drill bit may also have two or more movable jack elements. In the preferred embodiment, the jack element may protrude from an opening formed in a cutting element of the working portion. However, in other embodiments, the jack element protrudes from an opening formed in a junk slot area of the working portion. It may be beneficial for the drill bit to have two or more jack elements located in different positions within the working portion of the drill bit to reduce the wear on a single cutting element.

An actuator may be disposed in a bore of the drill bit that is adapted to retract the jack element. The actuator may have a stepper motor, an electrical motor, an electrically controlled valve, or combinations thereof. The actuator may be in communication with a down hole telemetry system. The actuator may have two or more rods adapted to engage concentric rings in communication with the jack element.

The working face may be eccentric to the central axis. In some embodiments a reamer may be fixed to the drill bit. In some embodiments the jack element may be rotationally isolated from the drill bit. In other embodiments the jack element may be rotationally fixed to the working face. The drill bit may be kinked in some embodiments. A distal end of the jack element may comprise a hard material selected from the group consisting of diamond, cubic boron nitride, carbide, nitride, or combinations thereof.

DETAILED DESCRIPTION OF THE INVENTION AND THE PREFERRED EMBODIMENT

Figure 1:
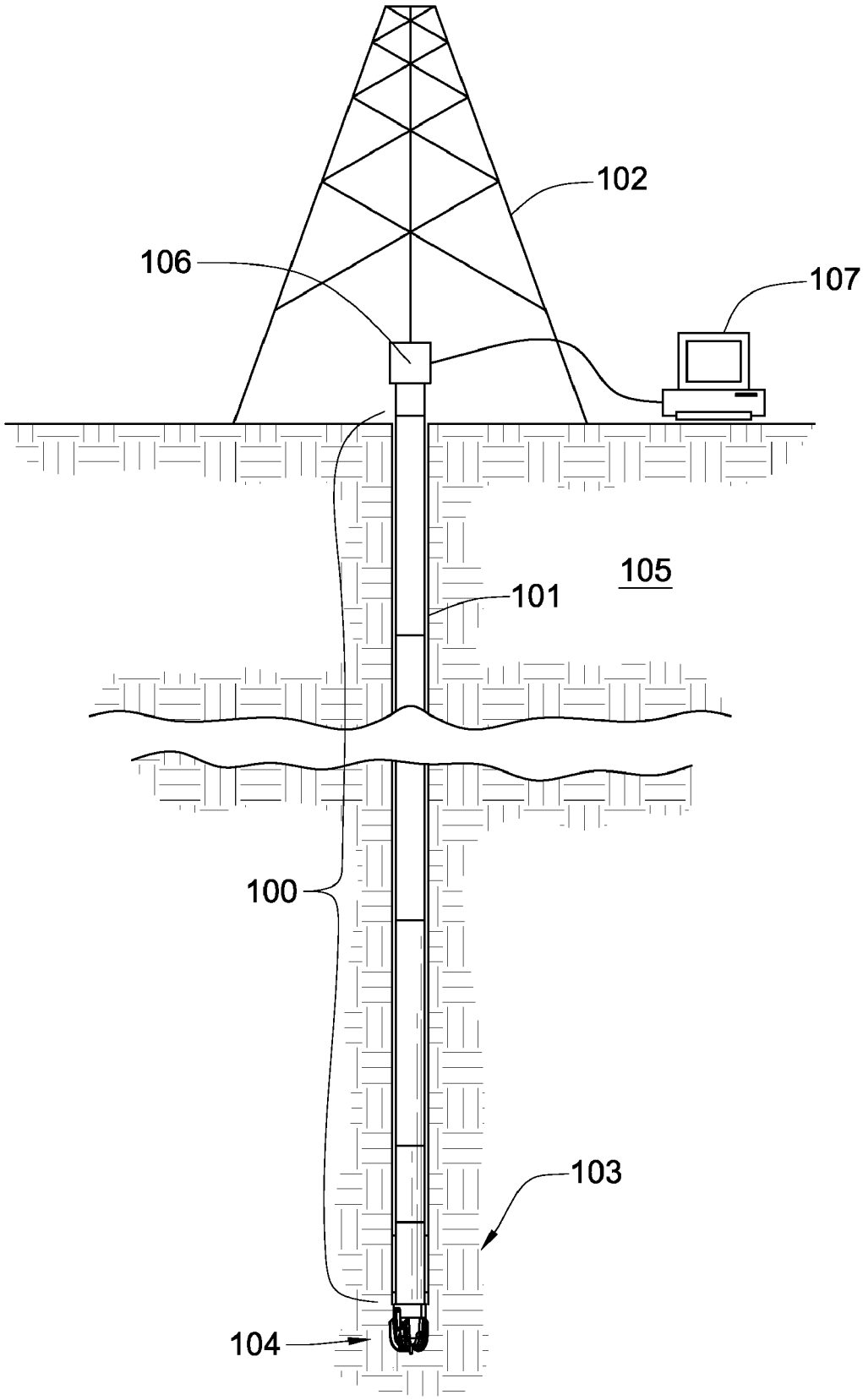
FIG. 1 is a perspective diagram of an embodiment of a drill string suspended in a borehole.

FIG. 1 is a perspective diagram of an embodiment of a drill string 100 suspended in a borehole 101 by a derrick 102. A bottom-hole assembly 103 is located at the bottom of the borehole 101 and comprises a drill bit 104. As the drill bit 104 rotates down hole the drill string 100 advances farther into the earth. The drill string 100 may penetrate soft or hard subterranean formations 105. The bottom-hole assembly 103 and/or down hole components may comprise data acquisition devices which may gather data. The data may be sent to the surface via a transmission system to a data swivel 106. The data swivel 106 may send the data to surface equipment 107. Further, the surface equipment may send data and/or power to down hole tools and/or the bottom-hole assembly 103. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
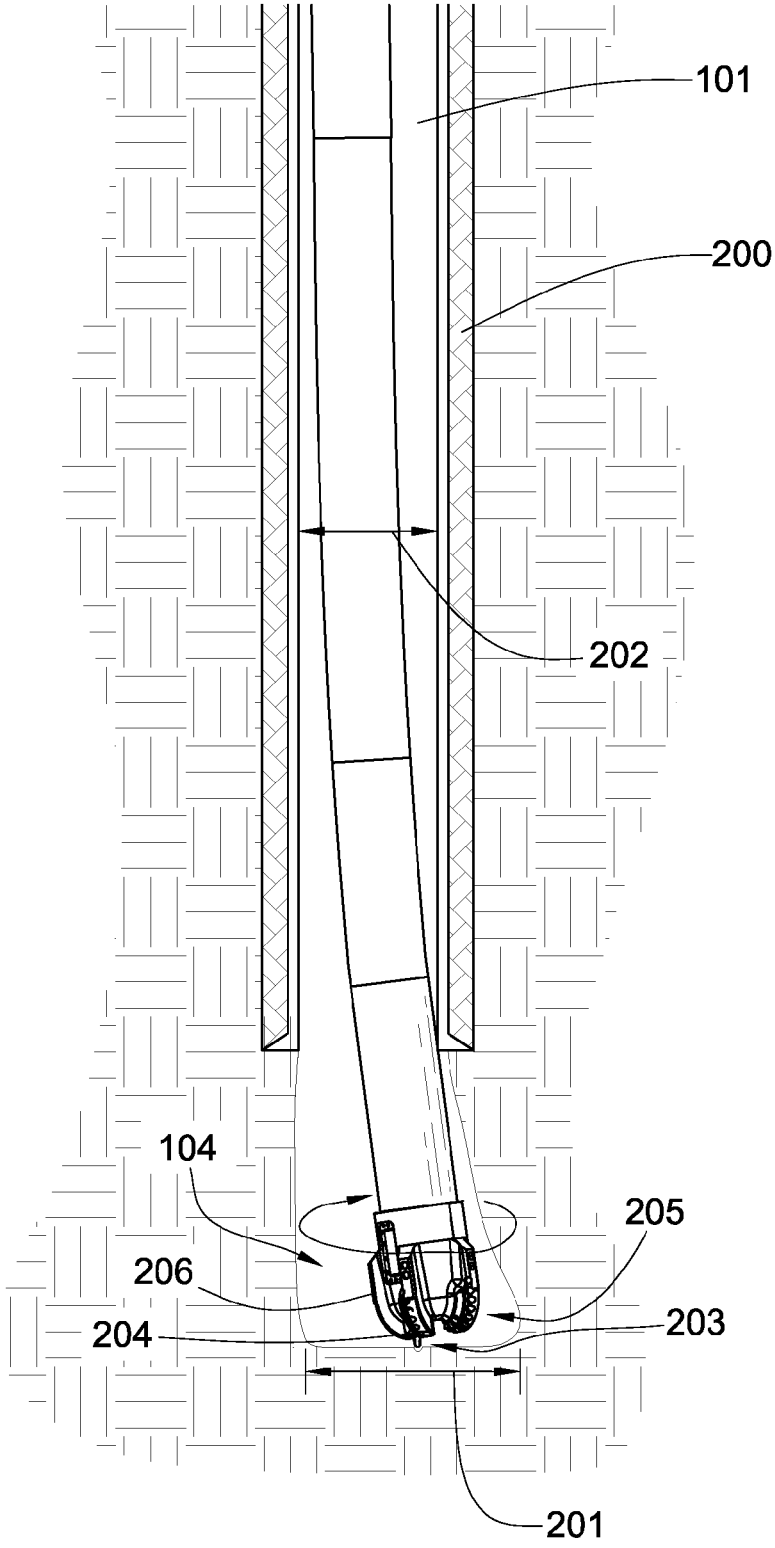
FIG. 2 is a perspective diagram of another embodiment of a drill string suspended in a borehole.

FIG. 2 is perspective diagram of another embodiment of a drill string 100 suspended in a borehole 101, the borehole having an existing casing 200. In the preferred embodiment, the drill bit 104 may be permitted to pass through the existing casing 200 and drill a new portion of the borehole that has a larger diameter 201 than a pass-through diameter 202 of the existing borehole. The larger diameter 201 may be formed when the drill bit 104 is rotated. A larger borehole can improve equivalent circulating density (ECD), allow extra casing, and overcome swelling and moving formation problems due to climactic changes or instability down hole. In the preferred embodiment, a jack element 203 protrudes from an opening 204 formed in a working portion 205 of the drill bit 104. It is believed that the jack element 203 will help to stabilize the drill bit while drilling in formations 105. The working portion 205 may also have a plurality of blades 350 to which the cutting elements 206 are attached. Some embodiments of the drill string 100 may also be used in horizontal or directional drilling.

Figure 2A:
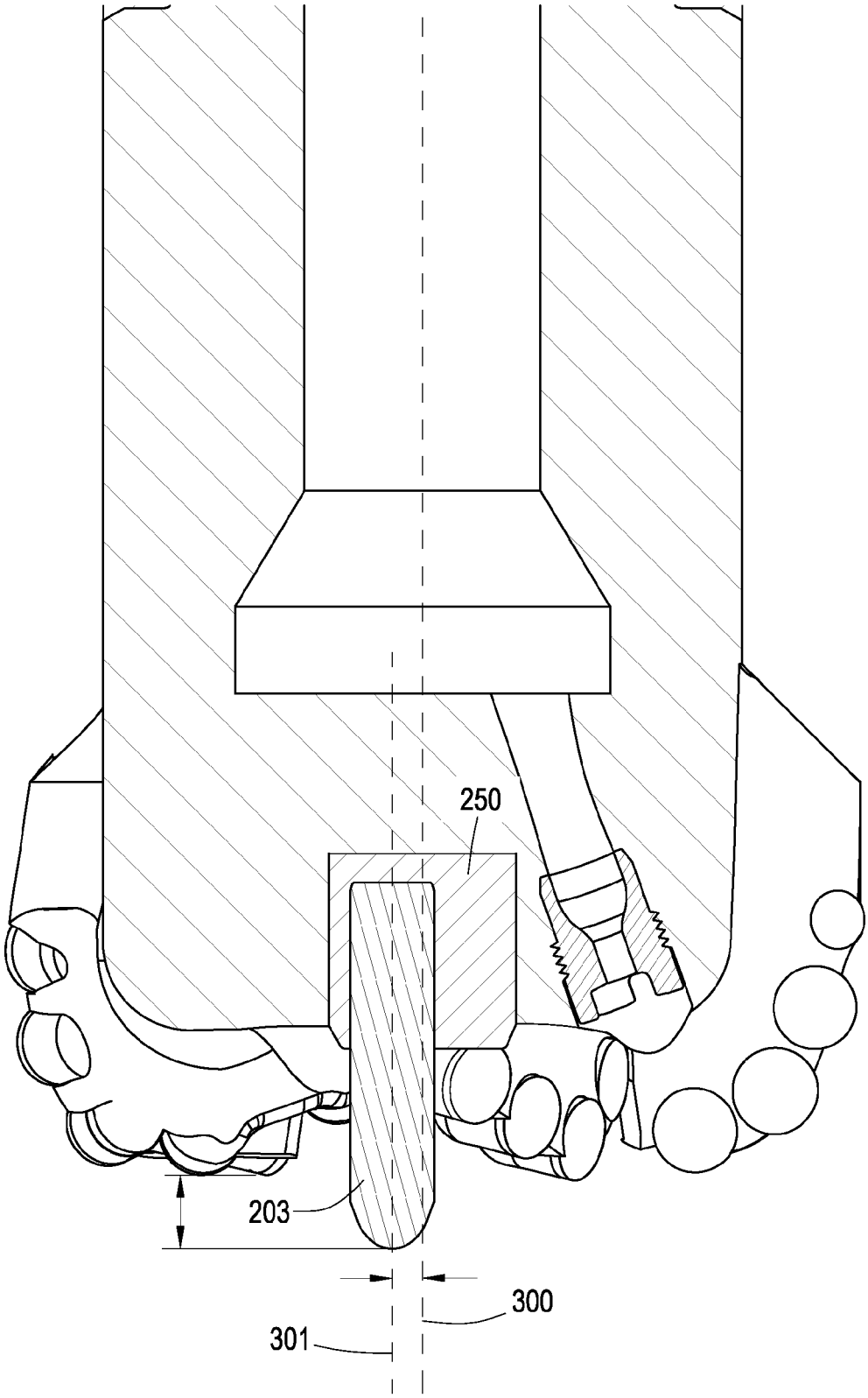
FIG. 2*a* is a perspective diagram of an embodiment of a drill bit assembly.

FIG. 2*a* discloses a drill bit with an off-center jack element. The jack element is press fit into an off-center receptacle in a bushing 250 which is brazed into the working face of the drill bit. As the drill bit rotates, the off-center jack element 203 acts a pivot point and forces the drill bit to cut a borehole diameter larger than the diameter of the drill bit.

Figure 3:
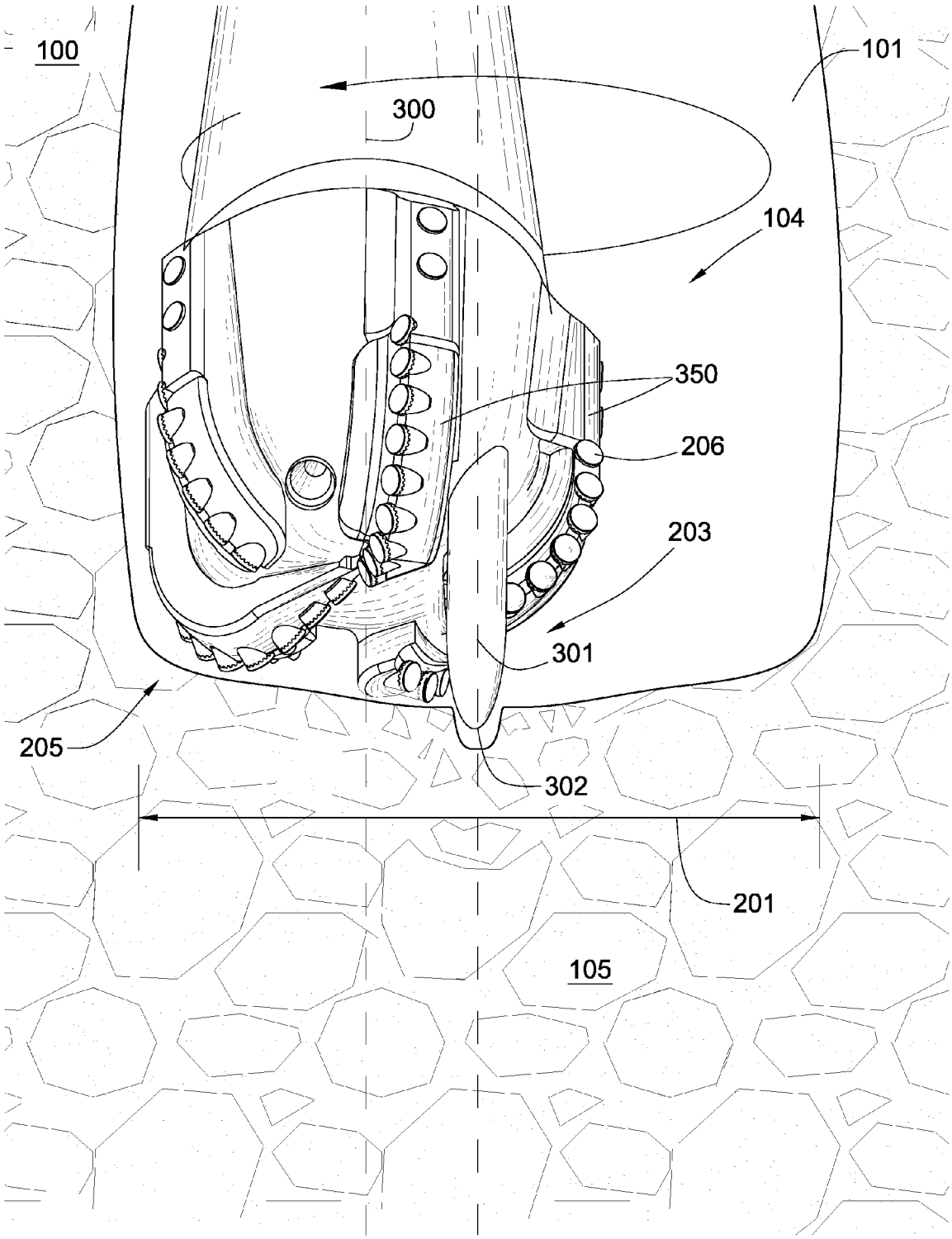
FIG. 3 is a perspective diagram of another embodiment of a drill bit assembly.

FIG. 3 is a perspective diagram of another embodiment of a drill string 100 suspended in a borehole 101. In the preferred embodiment, the drill bit 104 may have a central axis 300 that is eccentric to an axis of rotation 301. The jack element 203 protrudes from an opening 204 formed in the working portion 205. In this embodiment, the jack element 203 is positioned intermediate the cutting elements 206. The jack element 203 may have a distal end 302 that is adapted to contact the formation 105 at the axis of rotation 301. The distal end 302 may comprise a hard material selected from the group consisting of diamond, cubic boron nitride, carbide, nitride, or combinations thereof. In some embodiments, the jack element 203 may be rotationally isolated from the drill bit 104. In other embodiments, the jack element 203 may be rotationally fixed to the working portion 205. In the preferred embodiment, the drill bit 104 rotates around the jack element 203 during operation, such that a larger diameter 201, relative to the pass-through diameter, is formed.

Figure 4:
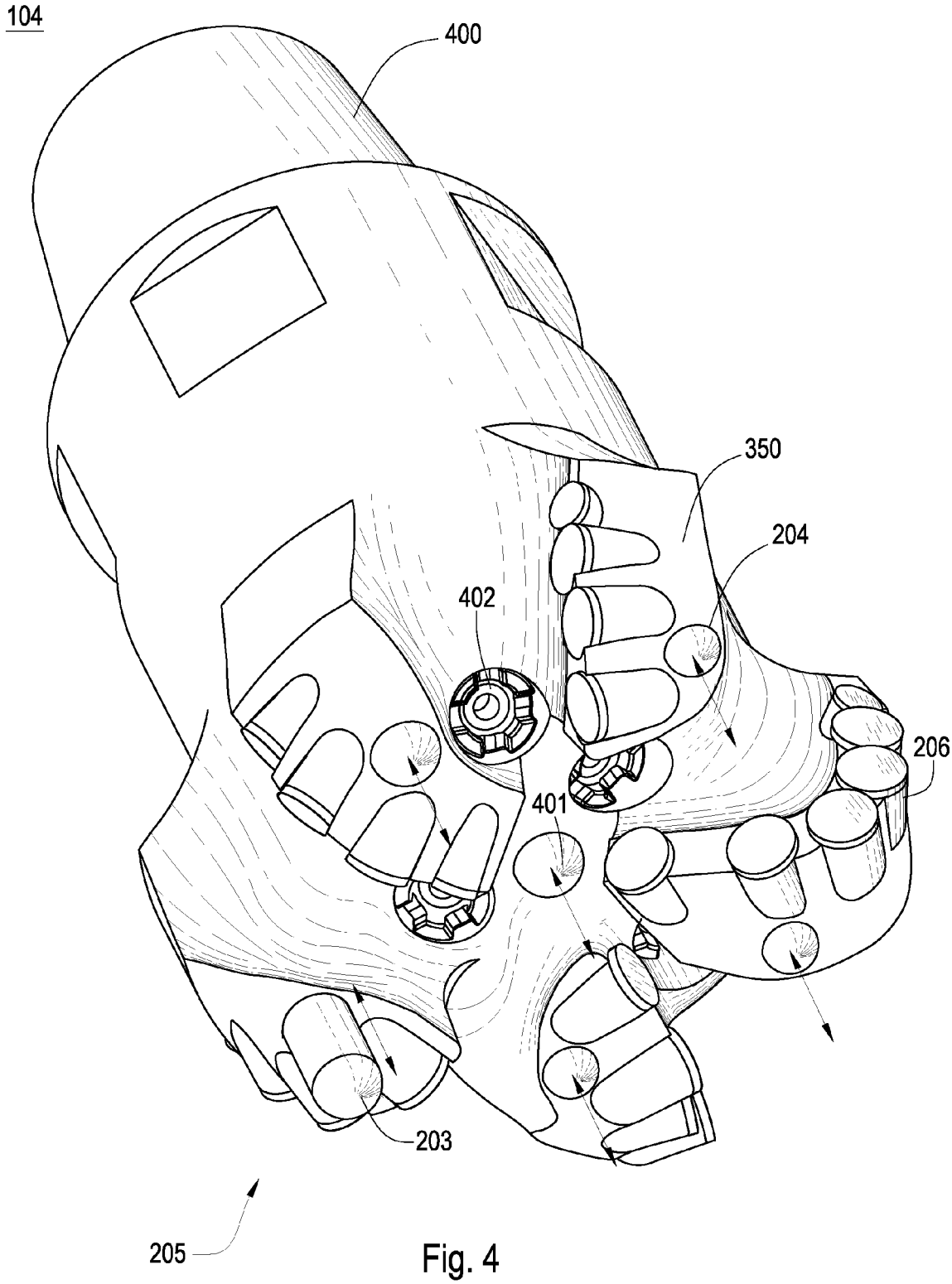
FIG. 4 is a perspective diagram of another embodiment of a drill bit assembly.

FIG. 4 is a perspective diagram of an embodiment of a drill bit assembly 104. The drill bit 104 may have a working portion 205 opposite a shank 400 of the bit 104. The shank 400 may be adapted to connect to a down hole drill string. The working portion 205 comprises a plurality of cutting elements 206. In the preferred embodiment, two or more openings 204 may be disposed in the working portion 205 and may be adapted to house separate jack elements 203. The drill bit 104 may also have two or more movable jack elements 203. In the preferred embodiment, the jack element 203 protrudes from an opening 204 formed in blades 350 of the working portion 205. A central jack element 401 may also protrude from the center of the working portion 205.

An actuator may be disposed in the bore of the drill bit 104 or within the body of the drill bit that is adapted to retract the jack element 203. It is believed that the cutting elements 206 and blades 350 opposite the protruding jack element 203 may receive the greatest wear during operation of the drill bit 104. The present invention may be beneficial since the wear to the blades and cutting elements may be more evenly distributed by switching jack elements. In this embodiment, one jack element 203 may protrude from the working portion 205 at a time. As damage is done to the opposite blade, the protruding jack element 203 may retract and another jack element may protrude from the working portion 205. The drill bit may rotate around the protruding jack element 203 such that different cutting elements and blades will receive increased loads. Thus, wear done to the cutting elements 206 and blades 350 may be evenly distributed during a drilling operation. The jack element 203 may comprise a base material from the group of hard materials consisting of hardened steel, tungsten carbide, niobium carbide, silicon carbide, cemented metal carbide, or combinations thereof. In some embodiments, the jack element 203 may be coated with a hard material from the group of hard materials consisting of diamond, cubic boron nitride, carbide, nitride, or combinations thereof.

At least one nozzle 402 may be disposed within an opening in the working portion 205 to control and direct the drilling fluid as well as control the flow of debris from the subterranean formation. In this embodiment, the nozzle 402 may direct the drilling fluid away from the jack element 203 in order to avoid erosion of the jack element 203.

Figure 5:
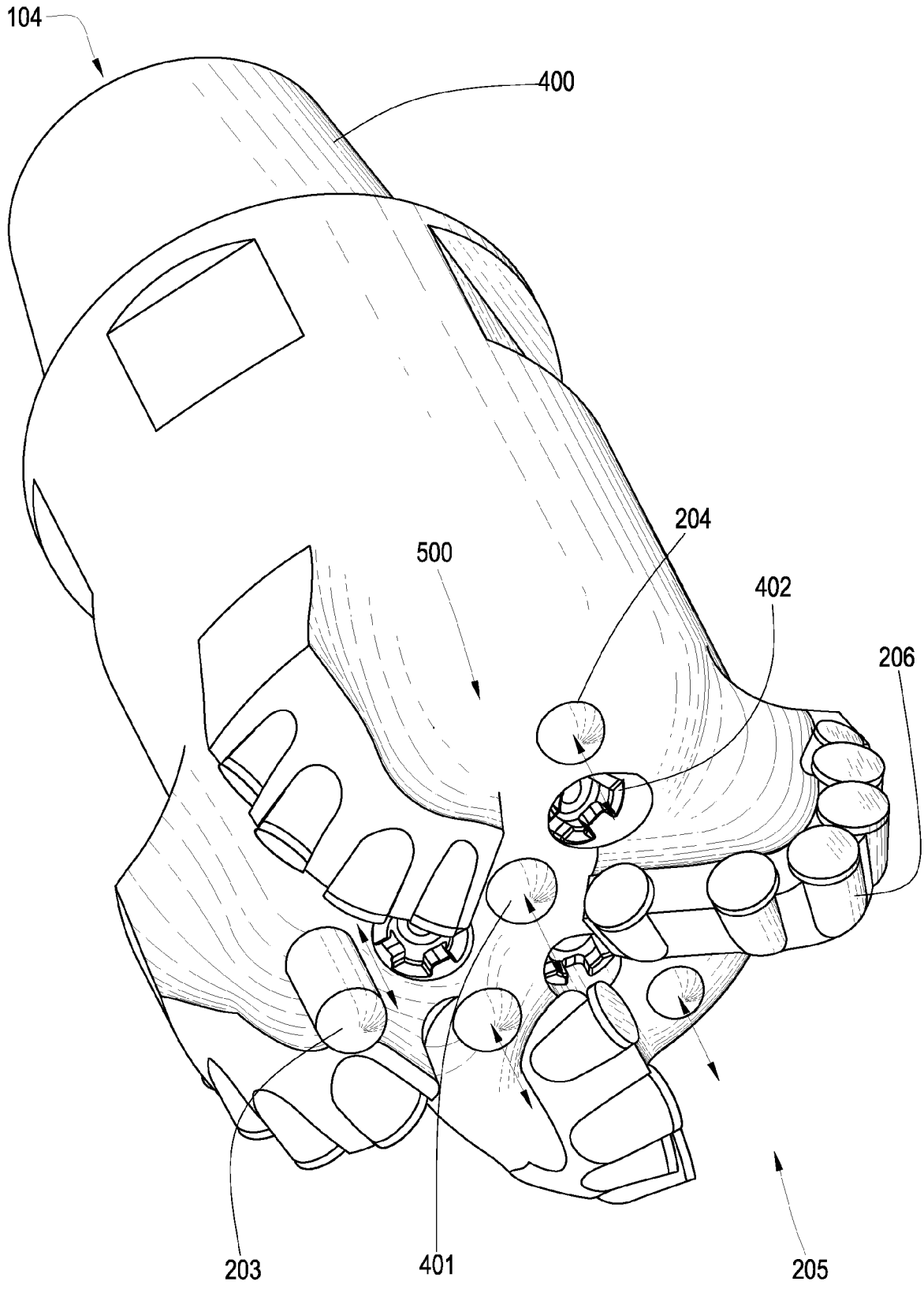
FIG. 5 is a perspective diagram of another embodiment of a drill bit assembly.

FIG. 5 is a perspective diagram of another embodiment of a drill bit assembly 104. In this embodiment, the jack element 203 protrudes from an opening 204 in a junk slot area 500 formed between the blades.

Figure 6:
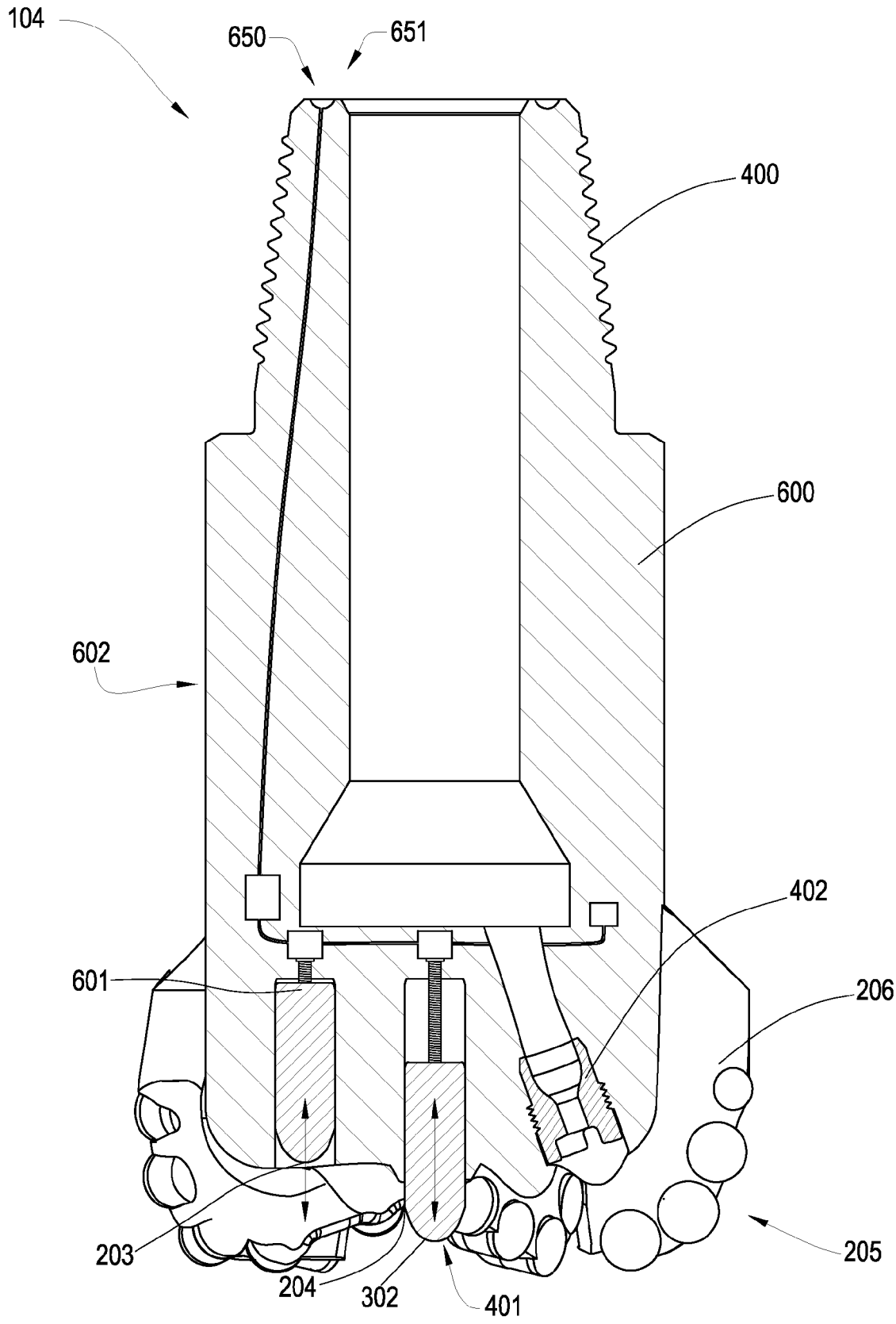
FIG. 6 is a cross sectional diagram of an embodiment of a drill bit assembly.

FIG. 6 is a cross-sectional diagram of an embodiment of a drill bit assembly 104. An actuator 601 may be disposed in a body 600 of the drill bit 104 that is adapted to retract the jack element 203. The actuator may have a stepper motor, an electrical motor, an electrically controlled valve, or combinations thereof. In the preferred embodiment the actuator 601 is in communication with a down hole telemetry system 602 disposed in the body 600 of the drill bit 104. Telemetry couplings may be disposed on the primary shoulder of the shank portion. The couplings may be inductive couplers, direct electrical contacts, acoustic couplers, or fiber optic couplers.

The actuator 601 may retract or extend the jack element 203 so that the drill bit 104 rotates around the protruding jack element. It may be beneficial to extend or retract a specific jack element in order to reduce the wear on a single cutting element 206 when the drill bit 104 is in operation down hole. The actuator may comprise a motor which rotates a rod comprising a thread form. The thread form may connect to a thread form on the jack element and when the motor rotates the jack element may be moved axially with respect to the drill bit. In other embodiments, a solenoid may be use to force the distal end of the jack element into contact with the formation. In other embodiments a hydraulic circuit may be used to actuate the jack elements axially. Such a system is described in U.S. patent application Ser. No. 11/306,022, now U.S. Pat. No. 7,198,119 which is herein incorporated by reference for all that is discloses.

In some embodiments, the jack element 203 may be rotationally isolated from the drill bit. In other embodiments, the jack element 203 may be rotationally fixed to the working portion 205. The drill bit 104 may also comprise at least one nozzle 402 disposed within the body 600 of the drill bit. Each jack element 203 may have a distal end 302 comprising of a hard material such as diamond. Each jack element 203 may also be comprised of a hard material such as tungsten carbide and may be coated with a hard material such as diamond to protect the jack element from stresses and harsh down hole conditions.

Figure 7:
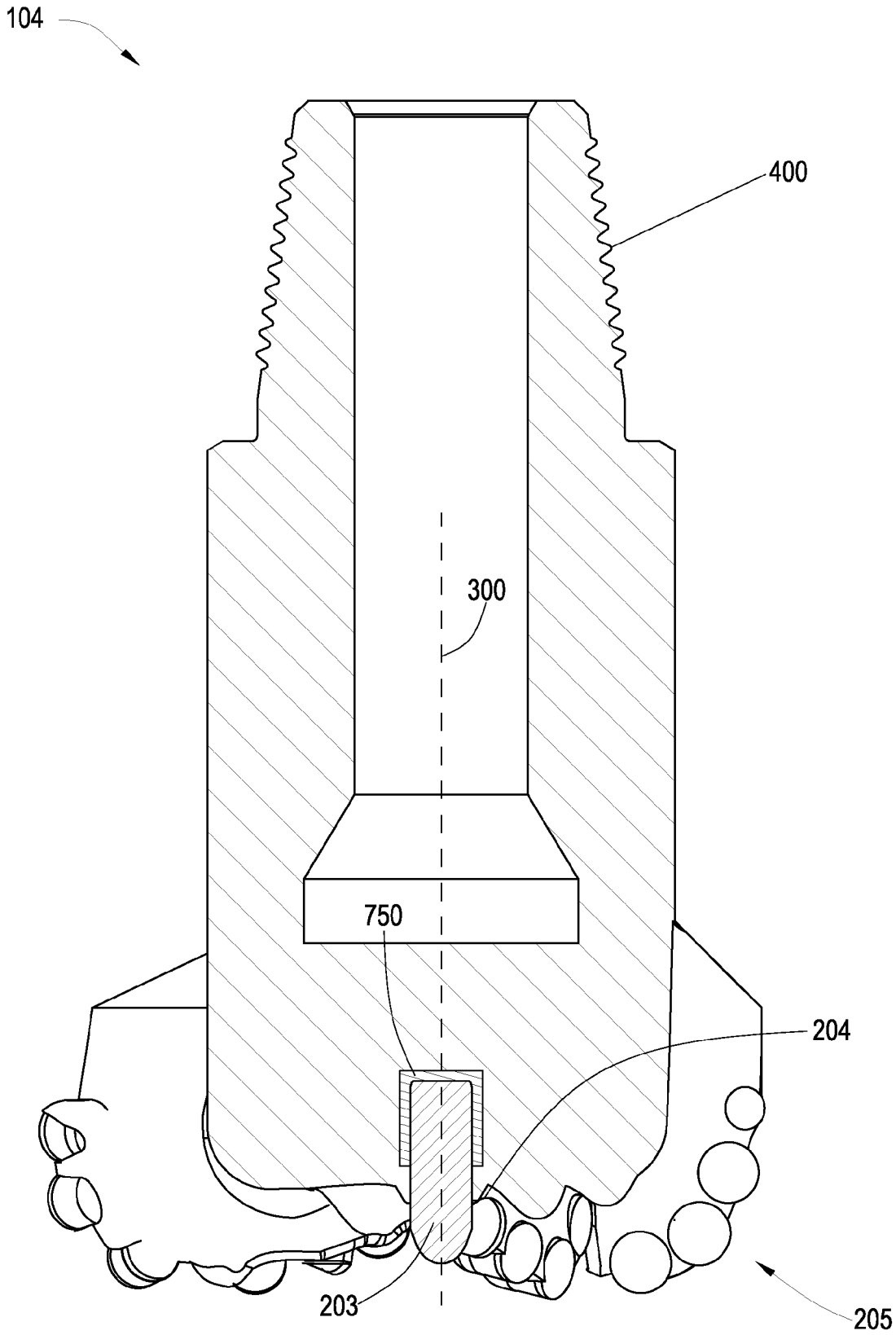
FIG. 7 is a cross sectional diagram of another embodiment of a drill bit assembly.

FIG. 7 is a cross-sectional diagram of another embodiment of a drill bit assembly 104. In this embodiment a jack element 203 may be coaxial with the axis of rotation 300 and may protrude from an opening 204 formed in the working portion 205. In this embodiment the working portion 205 may be eccentric to axis of rotation 300. In this embodiment the bit comprises blades of different sizes. In some embodiments, the jack element is press fit into a steel sleeve 750 which is brazed to the working face of the bit. This arrangement is believe to help attach the jack element more precisely since brazing may misalign the jack element as it shrinks during cooling. Once the sleeve has cooled the sleeve may be remachine if needed to get the orientation of the bit correct.

Figure 8:
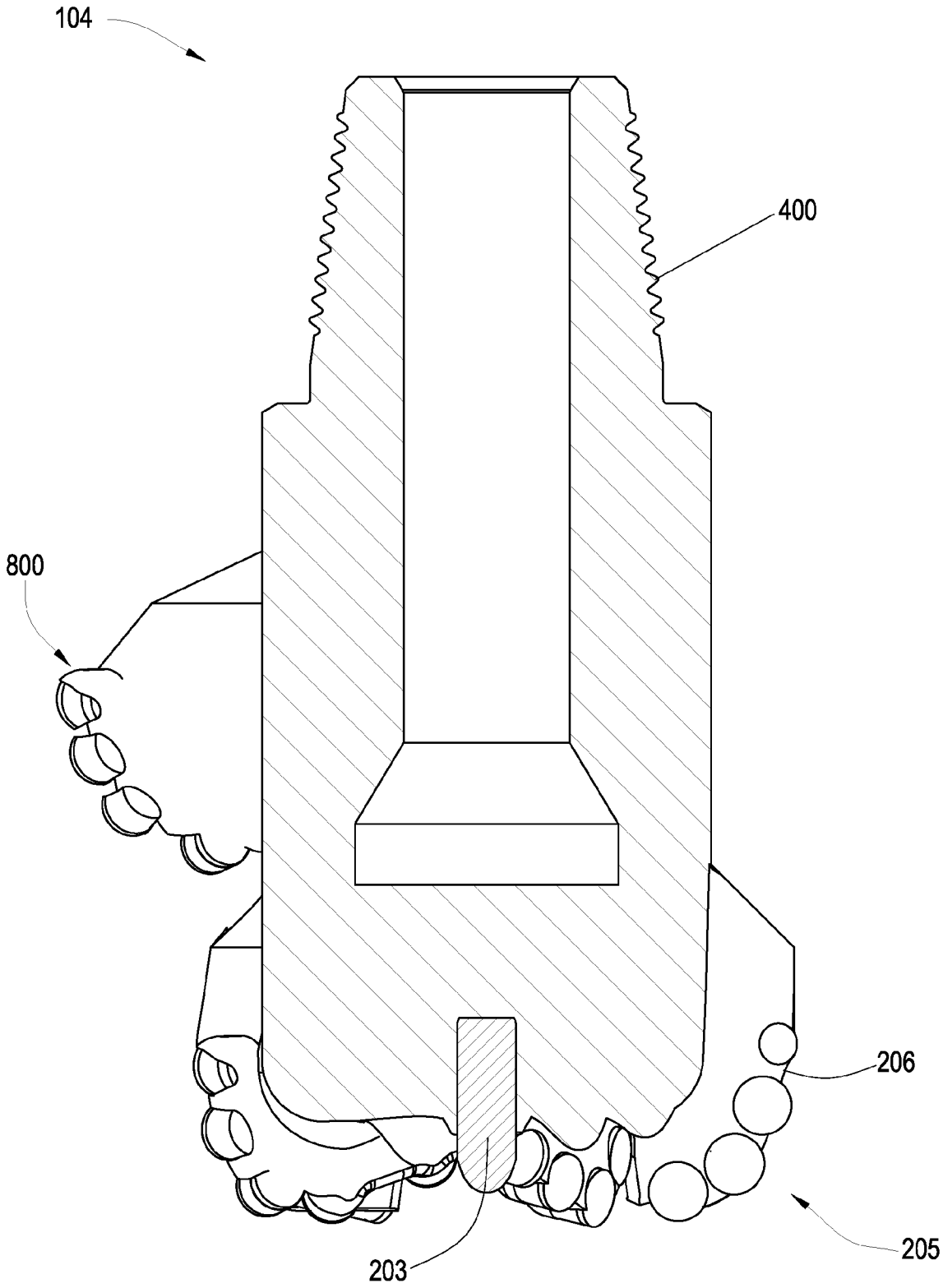
FIG. 8 is a cross sectional diagram of another embodiment of a drill bit assembly.

FIG. 8 is a cross-sectional diagram of another embodiment of a drill bit assembly 104. Again, in this embodiment, the jack element is generally coaxial with axis of rotation. A reamer 800 may be fixed to the drill bit 104. During a drilling operation, the drill bit 104 may drill out a borehole diameter larger than a pass-through diameter as the drill bit 104 rotates around the jack element 203.

Figure 9:
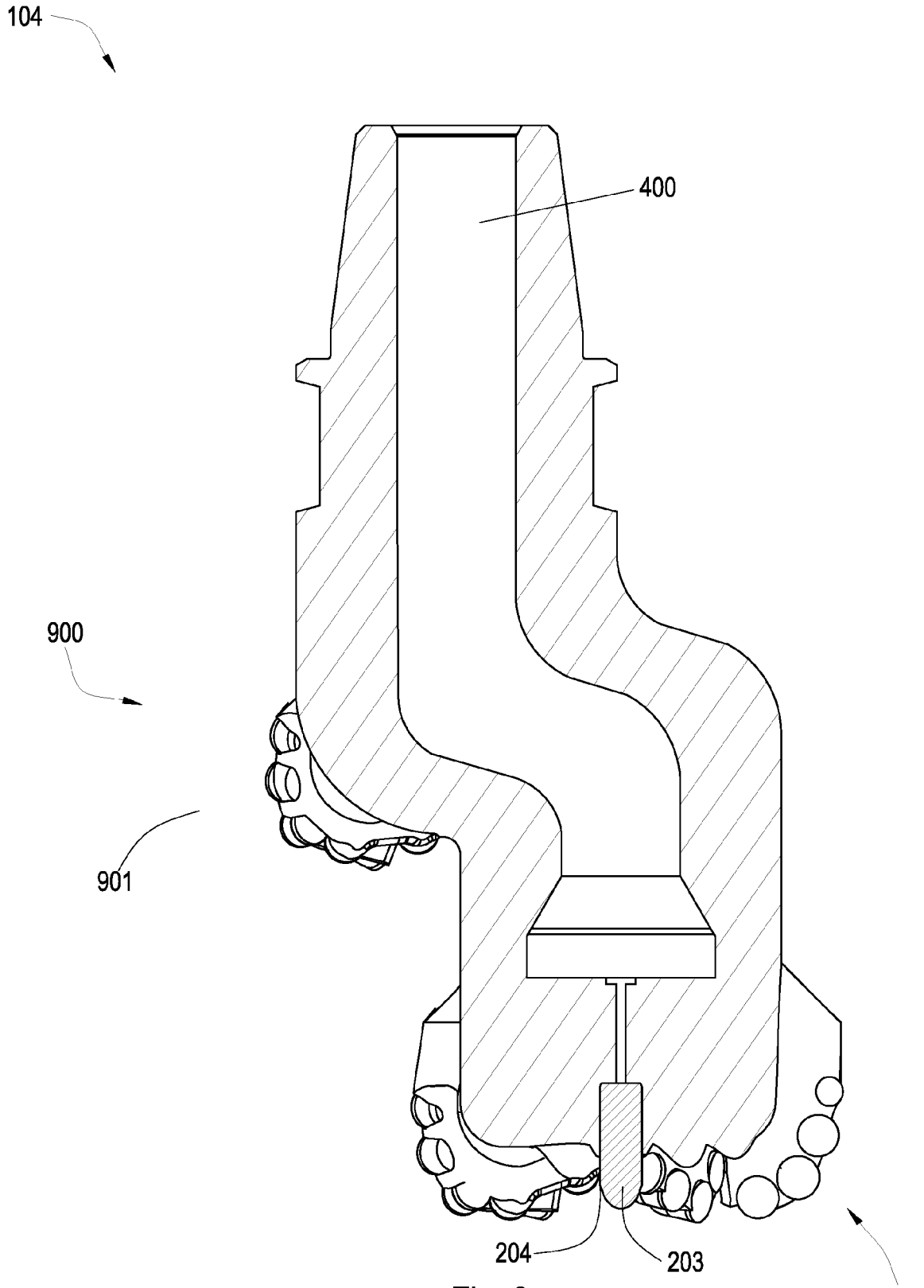
FIG. 9 is a cross sectional diagram of another embodiment of a drill bit assembly.

FIG. 9 is a cross-sectional diagram of another embodiment of a drill bit assembly 104. In this embodiment, the drill bit 104 may be kinked in order to drill a borehole with a larger diameter than a pass-through diameter when in operation. A kinked portion 900 of the drill bit 104 may comprise cutting elements 901 such that as the drill bit rotates during a drilling operation, the kinked portion 900 drills a larger borehole than the pass-through borehole.

Figure 10:
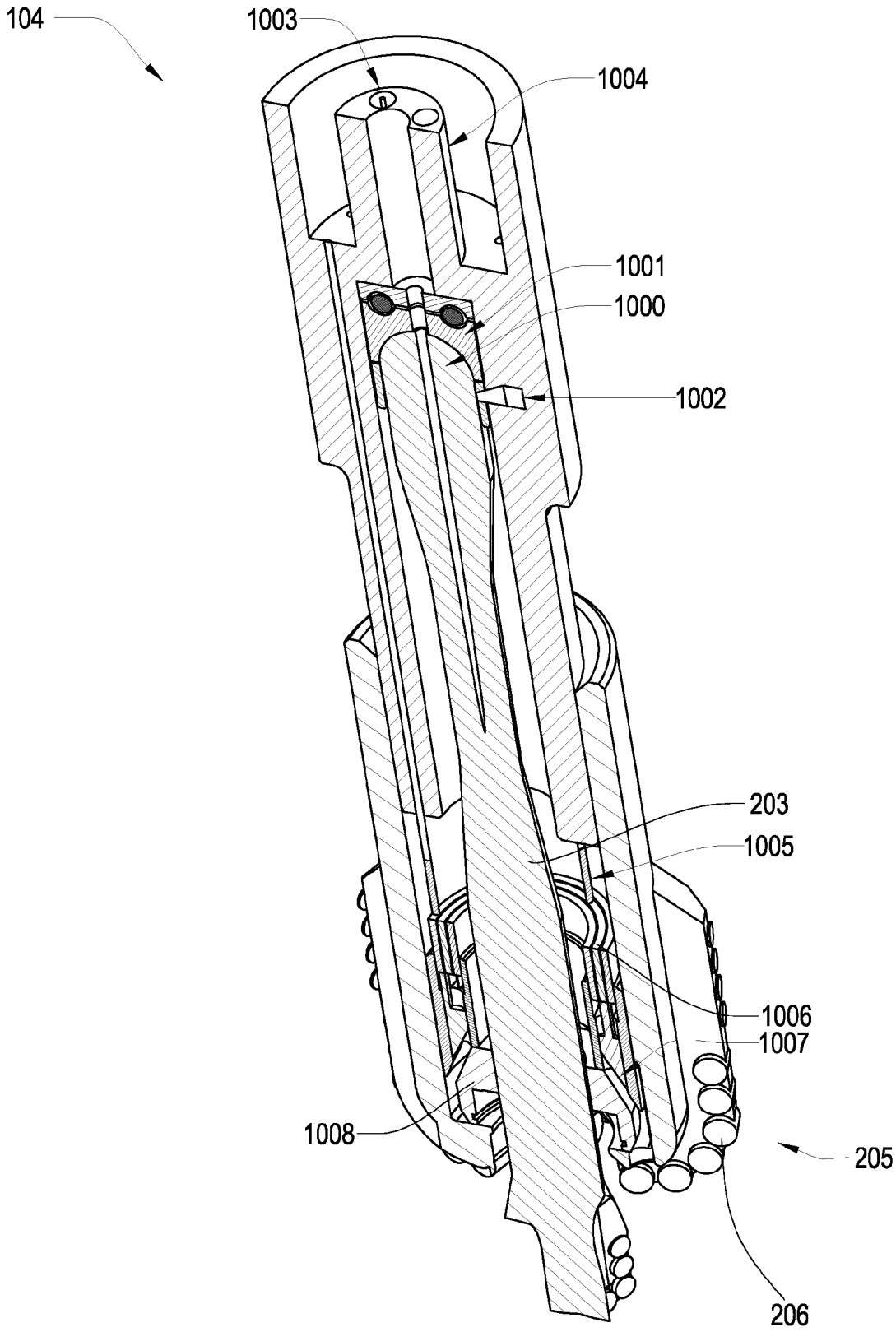
FIG. 10 is a cross sectional diagram of another embodiment of a drill bit assembly.

FIG. 10 is a cross-sectional diagram of another embodiment of a drill bit assembly 104. In this embodiment, a proximal end 1000 of a jack element 203 may be fitted within a rotationally isolated socket 1001. A brake 1002 may be disposed within the drill bit 104 and adapted to engage the jack element 203 such that, when desired, the jack element may be rotationally fixed to the drill bit 104. A turbine 1003 may be located proximate the rotationally isolated socket 1001 and may be protected in housing 1004; the turbine 1003 being adapted to drive a hydraulic circuit. The hydraulic circuit may be used to control an actuator that is adapted to retract or extend the jack element 203 from the working portion 205. The actuator may comprise a stepper motor, an electrical motor, an electrically controlled valve, or combinations thereof. The actuator may be in communication with a downhole telemetry system. Also, the actuator may have two or more rods 1005 adapted to engage concentric rings 1006. The rings 1006 may comprise a tapered end 1007 such that the tapered end 1007 is adapted to engage a tapered plate 1008 when the rings 1006 are engaged by the rods 1005. The tapered plate 1008 may be in mechanical communication with the jack element 203 such that when the rods 1005 engage the rings 1006, the tapered end 1007 of the rings 1006 pushes the tapered plate 1008 and applies a substantially normal force to the jack element 203. Each ring is adapted to apply a substantially normal force from a different direction to the jack element 203. This may be beneficial such that the position of the jack element 203 may be adjusted according to the wear done on the cutting elements 206. This embodiment may also be used in steering the drill bit 104. This design may bore a hole size that is 100-150% of its diameter, and also cut with a bi-center action using all of the cutters around the perimeter. The bore hole diameter may be controlled from the surface and may be actuated or pre-programmed within the bit. One benefit of the embodiment of FIG. 10 is that the bit may be modified during drilling to act as a bi-centered bit or a traditional drill bit.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a working portion opposite a shank of the bit, the working portion comprising a plurality of cutting elements;

a central axis eccentric to an axis of rotation of the drill bit assembly; and a jack element protruding from an opening formed in the working portion and comprising a distal end adapted to contact a formation at the axis of rotation.

2. The drill bit assembly of claim 1, wherein two or more openings disposed in the working portion are adapted to house separate jack elements.

3. The drill bit assembly of claim 1, wherein the drill bit comprises two or more movable jack elements.

4. The drill bit assembly of claim 1, wherein the jack element protrudes from an opening formed in a blade of the working portion.

5. The drill bit assembly of claim 1, wherein the jack element protrudes from an opening formed in a junk slot area of the working portion.

6. The drill bit assembly of claim 1, wherein an actuator disposed in a bore of the drill bit is adapted to retract the jack element.

7. The drill bit assembly of claim 6, wherein the actuator comprises a stepper motor, an electrical motor, an electrically controlled valve, or combinations thereof.

8. The drill bit assembly of claim 6, wherein the actuator is in communication with a downhole telemetry system.

9. The drill bit assembly of claim 6, wherein the actuator comprises two or more rods adapted to engage concentric rings in communication with the jack element.

10. The drill bit assembly of claim 1, wherein the working face is eccentric to the central axis.

11. The drill bit assembly of claim 1, wherein a reamer is fixed to the drill bit.

12. The drill bit assembly of claim 1, wherein the jack element is rotationally isolated from the drill bit.

13. The drill bit assembly of claim 1, wherein the jack element is rotationally fixed to the working portion.

14. The drill bit assembly of claim 1, wherein the shank portion is adapted for connection to a downhole drill string component.

15. The drill bit assembly of claim 1, wherein the drill bit is kinked.

16. The drill bit assembly of claim 1, wherein the jack element comprises a distal end comprising a hard material selected from the group consisting of diamond, cubic boron nitride, carbide, nitride, or combinations thereof.

17. The drill bit assembly of claim 1, wherein the jack element comprises a base material comprising a hard material selected from the group consisting of hardened steel, tungsten carbide, niobium carbide, silicon carbide, cemented metal carbide, or combinations thereof.

18. The drill bit assembly of claim 1, wherein the jack element comprises an outer layer comprising a hard material selected from the group consisting of diamond, cubic boron nitride, carbide, nitride, or combinations thereof.

19. The drill bit assembly of claim 1, wherein the jack element is coaxial with the axis of rotation.

20. The drill bit assembly of claim 1, wherein the jack element is press fit into a sleeve bonded to the working face.

* * * * *